United States Patent [19]

Higton et al.

[11] Patent Number: 4,859,904

[45] Date of Patent: Aug. 22, 1989

[54] HIGH CONTRAST ELECTROLUMINESCENT DISPLAYS

[75] Inventors: Malcolm H. Higton, Poole; Aron Vecht, London, both of United Kingdom

[73] Assignee: Phosphor Products Company Limited, Upton, United Kingdom

[21] Appl. No.: 198,687

[22] Filed: May 24, 1988

Related U.S. Application Data

[63] Continuation of Ser. No. 741,119, Jun. 4, 1985, abandoned, which is a continuation-in-part of Ser. No. 689,719, Jan. 8, 1985, abandoned.

[51] Int. Cl.[4] ..... H05B 33/22

[52] U.S. Cl. ..... 313/506; 313/503; 313/509

[58] Field of Search ..... 313/498, 503, 506, 509

[56] References Cited

U.S. PATENT DOCUMENTS 3,283,194 11/1966 Rulon ..... 313/509

3,854,070 12/1974 Vlasenko et al. ..... 313/509 X 4,137,481 1/1979 Hilsum et al. ..... 313/503

FOREIGN PATENT DOCUMENTS 798503 7/1958 United Kingdom .

OTHER PUBLICATIONS

Higton, "High Contrast Thin-film/Powder Composit DCEL Devices", Phosphor Products Co. Ltd., Poole England, pp. 29–33, 1984.

*Primary Examiner*—Kenneth Wieder

*Attorney, Agent, or Firm*—William R. Hinds

[57] ABSTRACT

A d.c. or a.c. electroluminescent panel comprises a transparent substrate, a transparent first electrode film, a thin film phosphor layer, a black or dark powder back layer of electrically conductive material, and a second electrode film. Application of a voltage across the phosphor layer causes it to emit light. In this invention, the black powder back-layer significantly enhances the contrast of the panel.

13 Claims, 1 Drawing Sheet

HIGH CONTRAST ELECTROLUMINESCENT DISPLAYS

Figure 1:
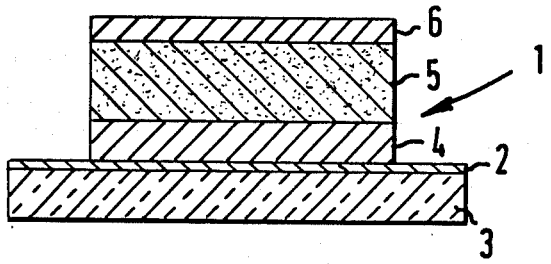

This application is a continuation of application Ser. No. 741,119 filed June 4, 1985, now abandoned, which is a continuation-in-part of application Ser. No. 689,719 filed Jan. 8, 1985, now abandoned.

This invention relates to electroluminescent (EL) phosphor panels and displays designed for undirectional voltage operation, (DCEL).

Thick film powder DCEL panels which are also capable of alternating voltage (ACEL) operation are conventionally manufactured by a process comprising the steps of:

(a) depositing a transparent front electrode film e.g. of tin oxide, onto a transparent insulating substrate, e.g. glass;

(b) spreading an active layer, comprising phosphor particles, such as zinc sulphide (ZnS) doped with an activator such as manganese (Mn) and coated with copper suspended in a binder medium, on the front electrode; this layer is typically 10–50 μm thick (hence 'thick film' device);

(c) depositing a back electrode film, e.g. of aluminium on the active layer;

(d) applying a unidirectional voltage to the electrode films for a predetermined time, so that in the region of the positively biased front electrode the copper coating is stripped from phosphor particles to form a high resistivity, high light output layer, typically 1–2 μm thick. The relatively thick layer of unstripped phosphor particles then remaining behind this thin light-emitting layer constitutes a highly conductive control layer.

The last step, (d) in the manufacturing process, is known as 'forming' and is more particularly described in U.K. Patent No. 1,300,548. The electrodes can of course be laid down in any desired shape to produce a particular display, e.g. if the electrodes comprise mutually perpendicular strips a matrix of active phosphor elements, or 'dots' will be defined each of which may be addressed and driven using conventional electronic techniques to form alphanumeric characters. Having such a process we have designed and built a 2000 character DCEL panel suitable for use with a computer as a monitor display and replacing the conventional bulky cathode ray tube monitor display.

A disadvantage of the all-powder panels is that the display elements can presently only produce a light output which, whilst acceptable in all but the highest ambient light conditions, is difficult to maintain throughout the life of the display. Moreover, since the quiescent color of the phosphor material is a very light shade of grey such high light output levels are required to provide an adequate display contrast.

The powder panels described above are known as 'self-healing', i.e. the copper-coated powder backlayer, the control layer, protects the thin, high resistance, light-emitting 'formed' layer from catastrophic breakdown due to excessive current density at defects or points of weakness by further copper stripping or 'forming' at such 'hot spots'.

To ensure a more reproducible manufacturing technique, not requiring the expensive and time-consuming forming operations, a composite thin film powder electroluminescent panel has been proposed (see 'A Composite ZnS Thin Film Powder Electroluminescent Panel' C. J. Alder et al, Displays, January 1980, at page 191). Such panels are in effect a hybrid structure in which a thin film, equivalent to the light-emitting formed layer in conventional DCEL panels, is coated with the copper-coated phosphor backlayer, i.e. control layer. The thin film is of semi-insulating activator-doped phosphor, such as ZnS doped with Mn, and is typically 200 A to 1 μm thick. This light-emitting film is deposited onto the transparent front electrode of the panel by sputtering, evaporation, electrophoretic plating or any of the known ways of depositing thin films on substrates. The conventional control layer and the back electrode are spread and vacuum-deposited onto the light-emitting film in the known manner. The control layer need not contain Mn since the light emitted by the device originates from the thin film. U.S. Pat. No. 4,137,481 describes such a hybrid panel which may or may not require the application of a forming current before it is ready for use. If a forming current is required, forming is found to occur at much lower current densities than those required for conventional thick film DCEL panels.

The hybrid DCEL panel is protected by the control layer from catastrophic breakdown due to excessive current density at defects and points of weakness by retaining its forming properties in the same way as the "thick film powder only" DCEL panels. However, the known hybrid panels using conventional control layers still suffer from the effects of further forming during extensive use, leading to brightness degradation with time. Again, the contrast provided by such known hybrid devices is poor.

It is an object of the present invention to provide a thin film powder composite EL (hybrid) panel with improved brightness maintenance during its operational lifetime and providing significant contrast enhancement.

It is a further object of the present invention to provide a thin film powder composite panel that is cheaper to manufacture than known powder DCEL panels.

The present invention is based on the realisation that materials other than phosphors have the property of controlling the current supplied to the first layer of activator-doped phosphor. Thus, the choice of mterials that can be used for the control layer is much greater and materials can be selected for other advantageous properties that they possess. In particular in accordance with the present invention, a material is chosen that has a dark hue, which means that the contrast of the panel will be greatly improved and its legibility will be greatly increased.

Phosphors necessarily have a relatively large band gap or otherwise they would not be phosphorescent and this results in the phosphor having a grey colour. Thus, the present invention is distinguished from known art by using a material in the control layer that has a dark colour; and in that the material chosen for the dark control layer also is sufficiently electrically conductive to provide the necessary current flow to the panel without the use of further electrodes. This reduces the cost of providing the electrodes and hence reduces manufacturing costs.

In known panels suitable for multiplex addressing the two sets of electrodes are each composed of thin parallel strips of conductive material. The electrodes of one set extend perpendicularly to the electrodes of the other set and pixels are thus formed in the areas that are sandwiched between an electrode of each set.

The set of electrodes on the rear of the panel, i.e. on the side of the panel remote from the transparent substrate, have customarily been provided by vacuum-deposition of aluminium. However if an electrically conductive material is chosen for the conductive layer, the rear set of electrodes can be dispensed with if the control layer is formed in ridges running perpendicularly to the strips of the front transparent electrode film. This may be achieved by grooving or "scribing" a uniformly deposited control layer with a thin instrument, which is a much cheaper operation than depositing thin strips of aluminium electrodes on the back of the panel.

According to the present invention, an electroluminescent phosphor panel suitable for unidirectional voltage operation, comprises in serial order, a transparent electrically insulating substrate, a transparent first electrode film, a first layer in the form of a thin film of substantially insulating phosphor and a second layer which is a control layer of powder material, wherein the improvement consists in that: (A) the said thin film first layer is the sole light-emitting layer; and (b) the said powder material is: (i) inherently dark-colored, (ii) one of electrically conducting and semi-conducting, (iii) not a phosphor, and (iv) free of activator doping; and (C) the particles of said powder material are free of metallic coating.

Two embodiments of the invention will now be described by way of example and with reference to the accompanying drawings (FIGS. 1 and 2) which are cross-sectional views of the two EL panels.

Referring to FIG. 1, the panel indicated by reference numeral 1, includes a transparent tin oxide or indium tin oxide electrode 2 laid, for example, by sputtering on part of the upper surface of a glass substrate 3. The electrode 2 can be etched to any desired shape or pattern depending on the type of display required; for example, the display required may be a dot matrix display in which case the electrode 2 will take the form of a plurality of parallel strips of width and spacing determined by the desired 'dot' (pixel) size.

A semi-insulating thin film 4 of self-activated or activator-doped phosphor, not more than 5 microns thick, is deposited on the electrode 2. The film for example may be ZnS activated with Mn in which case the display will exhibit a yellow colour in operation. Alternative colours may be effected by using activators other than Mn in ZnS, and other lattices with Mn and activators such as rare earth metals. For example, other phosphor lattices which may also be used are the alkaline sulphides BaS, CaS and SrS, fluorides such as $LaF_3$ and $YF_3$ and oxides such as $Y_2O_3$ or any other suitable phosphor.

A powder control layer 5 is deposited on the thin film 4. The control layer is preferably black, but essentially dark in colour and is selected from transition metals, rare earth metal, or other metal compounds such as oxides, sulphides or other chalcogenides. It may for example, by PbS, PbO, CuO, $MnO_2$, $Tb_4O_7$, $Eu_2O_3$, $PrO_2$ or $Ce_2S_3$.

An aluminium electrode 6 is deposited, for example, by evaporation on to the control layer 5. This electrode can be mechanically scribed to provide a shape corresponding or relating to the electrode 2 to form the desired display pattern, for example if a dot matrix display is required the electrode 6 will take the form of a plurality of parallel strips mutually perpendicular to the strips of electrode 2 so that the 'intersections' of the two sets of strips define the display pixels.

Electrode 2 can be either positively or negatively biased. In operation a DC voltage, typically between 20 and 200 V, is applied across the electrodes 6 and 2. Light is emitted from the thin film 4, in a pattern determined by the electrode shape. The contrast between the light-emitting region of the thin film 4 and the non-light-emitting region is enhanced by using a black or dark powder control layer 5, so that the display may be read by an observer even in relatively high ambient light conditions and with display brightness of only a few foot-lamberts, typically 4–15 fL.

Two such panels have been built and tested and produced yellow and green displays respectively with good contrast enhancement. In the first, the thin film layer 4 comprised ZnS activated with Mn and in the second, the thin film layer 4 comprised ZnS activated with $TbF_3$. In both cases, the control layer 5 was black $MnO_2$ powder. The ZnS thin film/$MnO_2$ powder panels are extremely stable with respect to current control and brightness maintenance under pulsed DC excitation, at constant voltage operation.

Examples of these yellow emitting displays have been made which have exhibited, for example, in the first case, an almost constant brightness of 8 fL under 43 V pulsed DC excitation of 10 $\mu$S pulses at 1% duty cycle for over 2400 hours operation at between 0.05 and 0.02% W/W efficiency, and in the second case 11 fL to over 3000 hours operation. The green emitting ZnS thin film/$MnO_2$, where the ZnS is activated with $TbF_3$ have produced a brightness of 3–4 fL after 2400 hours at 77 V pulsed DC excitation.

Figure 2:
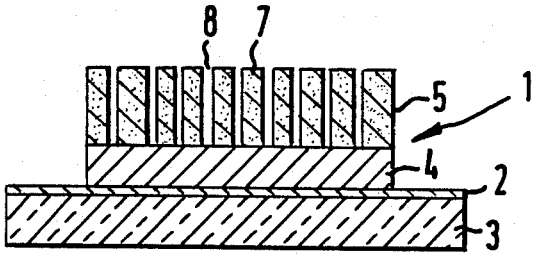

The panel shown in FIG. 2 is identical to that shown in FIG. 1 (and like reference numbers have been used to indicate like parts) with the exception that the rear electrodes 6 have been omitted and the powder layer 5 has been formed into discrete ridges 7 separated by furrows or grooves 8. An electrical connection (not shown) is made to each of the ridges 7 of the powder layer 5.

The embodiment shown in FIG. 2 is intended for multiplex addressing and so transparent electrode film 2 is formed in strips running perpendicular to (or intersecting) the furrows 8.

We claim:

1. An electroluminescent phosphor panel suitable for unidirectional voltage operation, comprising in serial order, a transparent electrically insulating substrate, a transparent first electrode film, a first layer in the form of a thin film of substantially insulating phosphor and a second layer which is a control layer of powder material, the improvement consisting in that:

(A) the said thin film first layer is the sole light-emitting layer; and (B) the said powder material is:

(i) inherently dark-colored, (ii) one of electrically conducting and semi-conducting, (iii) not a phosphor, and (iv) free of activator doping; and (C) the particles of said powder material are free of metallic coating.

2. An electroluminescent phosphor panel suitable for unidirectional voltage operation, comprising in serial order, a transparent electrically insulating substrate, a transparent first electrode film, a first layer in the form of a thin film of substantially insulating phosphor and a second layer which is a control layer of powder material, the improvement consisting in that:

(A) the said thin film first layer is the sole light-emitting layer; and (B) the said powder material is:

(i) inherently dark-colored, having a band gap of 1.8 eV, (ii) one of electrically conducting and semi-conducting, (iii) not a phosphor, (iv) free of activator doping; and (C) the particles of said powder material are free of metallic coating.

3. An electroluminescent phosphor panel suitable for unidirectional voltage operation, comprising in serial order, a transparent electrically insulating substrate, a transparent first electrode film, a first layer in the form of a thin film of substantially insulating phosphor and a second layer which is a control layer of powder material, the improvement consisting in that:

(A) the said thin film first layer is the sole light-emitting layer; and (B) the said powder material is:

(i) inherently dark-colored, (ii) one of electrically conducting and semi-conducting, (iii) not a phosphor, (iv) selected from the group consisting of PbS, PbO, CuO, $MnO_2$, $Tb_4O_7$, $Eu_2O_3$, $PrO_2$ and $Ce_2S_3$; and (C) the particles of said powder material are free of metallic coating.

4. An electroluminescent phosphor panel suitable for unidirectional voltage operation, comprising in serial order, a transparent electrically insulating substrate, a transparent first electrode film, a first layer in the form of a thin film of substantially insulating phosphor and a second layer which is a control layer of powder material, the improvement consisting in that:

(A) the said thin film first layer is the sole light-emitting layer; and (B) the said powder material is $MnO_2$ powder free of metallic coating and free of activator doping, the said $MnO_2$ powder being an inherently dark-colored, electrically conducting, non-phosphor material; and (C) the particles of said powder material are free of metallic coating.

5. An electroluminescent phosphor panel suitable for unidirectional voltage operation, comprising in serial order, a transparent electrically insulating substrate, a transparent first electrode film, a first layer in the form of a thin film of substantially insulating phosphor and a second layer which is a control layer of powder material, the improvement consisting in that:

(A) the said thin film first layer is the sole light-emitting layer; and (B) the said powder material is:

(i) inherently dark-colored, (ii) electrically conducting, (iii) not a phosphor, (iv) selected from the group consisting of PbS, PbO, CuO, $MnO_2$, $Tb_4O_7$, $Eu_2O_3$, $PrO_2$ and $Ce_2S_3$; and (C) the particles of said powder material are free of metallic coating; and (D) the said second layer is composed of discrete ridges separated from each other by furrows, and is effective for direct coupling to a source of electric power without the intermediation of an electrode.

6. A panel according to claim 1, wherein the powder of the second layer is selected from the group consisting of transition metal oxides, transition metal sulfides, rare earth metal oxides and rare earth metal sulfides.

7. A panel according to claim 1, wherein the powder of the second layer is selected from the metal chalcogenides.

8. A panel according to claim 1, wherein the powder of the second layer is selected from metal oxides.

9. A panel according to claim 1, wherein the powder of the second layer is selected from metal sulfides.

10. A panel according to claim 1, wherein the powder of the second layer is selected from the group consisting of PbS, PbO, CuO, $MnO_2$, $Tb_4O_7$, $Eu_2O_3$, $PrO_2$ and $Ce_2S_3$.

11. A panel according to claim 1, where the band gap of the said second layer is less than 1.8 eV.

12. A panel according to claim 1, which includes a second electrode in contact with the side of the second layer remote from the substrate.

13. A panel according to claim 1, wherein the second layer is composed of discrete ridges separated from each other by furrows.

* * * * *